US011378077B2

(12) United States Patent
Usami et al.

(10) Patent No.: US 11,378,077 B2
(45) Date of Patent: Jul. 5, 2022

(54) GEAR PUMP DEVICE HAVING THREE MEMBER SEAL MECHANISM CONTAINING FITTED INSERTION PART TO SEAL AXIAL FACE OF GEAR PUMP BETWEEN INNER AND OUTER GEAR

(71) Applicant: ADVICS CO., LTD., Kariya (JP)

(72) Inventors: Tadayoshi Usami, Toyoake (JP); Kunihito Ando, Okazaki (JP)

(73) Assignee: ADVICS CO., LTD., Kariya (JP)

( * ) Notice: Subject to any disclaimer, the term of this patent is extended or adjusted under 35 U.S.C. 154(b) by 185 days.

(21) Appl. No.: 16/623,709

(22) PCT Filed: Jun. 22, 2018

(86) PCT No.: PCT/JP2018/023747
§ 371 (c)(1),
(2) Date: Dec. 17, 2019

(87) PCT Pub. No.: WO2018/235928
PCT Pub. Date: Dec. 27, 2018

(65) Prior Publication Data

US 2020/0141402 A1 May 7, 2020

(30) Foreign Application Priority Data

Jun. 23, 2017 (JP) ..... JP2017-123473

(51) Int. Cl.
*F04C 15/00* (2006.01)
*F04C 2/10* (2006.01)
*F04C 2/08* (2006.01)

(52) U.S. Cl.
CPC ..... *F04C 15/0026* (2013.01); *F04C 2/102* (2013.01); *F04C 2/084* (2013.01);
(Continued)

(58) Field of Classification Search
CPC ..... F04C 15/0026; F04C 2/102; F04C 2/084; F04C 15/0019; F04C 15/008;
(Continued)

(56) References Cited

U.S. PATENT DOCUMENTS 8,747,089 B2 * 6/2014 Nakamura ..... F16J 15/061 418/104
9,046,102 B2 * 6/2015 Naganuma ..... F04C 15/0026
(Continued)

FOREIGN PATENT DOCUMENTS

JP 2016028192 A 2/2016

OTHER PUBLICATIONS

International Search Report (PCT/ISA/210) dated Sep. 11, 2018, by the Japanese Patent Office as the International Searching Authority for International Application No. PCT/JP2018/023747.
(Continued)

*Primary Examiner* — Dominick L Plakkoottam
*Assistant Examiner* — Paul W Thiede
(74) *Attorney, Agent, or Firm* — Buchanan Ingersoll & Rooney PC

(57) ABSTRACT

Provided is a gear pump device that enables improvement in volumetric efficiency and manufacturability, and also makes it possible to ensure sealing property and to reduce drive torque. According to the present invention, a sealing mechanism is provided with an annular rubber member, an outer member, and an inner member, wherein: the inner member has, at an end of an outer peripheral wall on the side of an inner gear in the axial direction, a notch which is recessed radially inward of the inner gear so as to form, together with an axial one end face of the inner gear, a depressed part; and the outer member has an insertion part which is disposed within the depressed part and which abuts against the axial
(Continued)

one end face of the inner gear so as to constitute a part of a sealing surface on the other side.

8 Claims, 4 Drawing Sheets

(52) U.S. Cl.
CPC ..... *F04C 15/008* (2013.01); *F04C 15/0019* (2013.01); *F04C 2230/602* (2013.01); *F04C 2240/30* (2013.01); *F04C 2240/56* (2013.01)

(58) Field of Classification Search
CPC .... F04C 2240/30; F04C 2240/56; F04C 2/18; F16J 15/061; F16J 15/34; F16J 15/344; F03D 9/25
See application file for complete search history.

(56) References Cited

U.S. PATENT DOCUMENTS

| | | | | |
|---|---|---|---|---|
| 9,556,869 | B2 * | 1/2017 | Hashiba | F04C 2/18 |
| 9,835,155 | B2 * | 12/2017 | Hashiba | B60T 17/02 |
| 2016/0010645 | A1 | 1/2016 | Hashiba et al. | |

OTHER PUBLICATIONS

Written Opinion (PCT/ISA/237) dated Sep. 11, 2018, by the Japanese Patent Office as the International Searching Authority for International Application No. PCT/JP2018/023747.

* cited by examiner

GEAR PUMP DEVICE HAVING THREE MEMBER SEAL MECHANISM CONTAINING FITTED INSERTION PART TO SEAL AXIAL FACE OF GEAR PUMP BETWEEN INNER AND OUTER GEAR

TECHNICAL FIELD

The present invention relates to a gear pump device.

BACKGROUND ART

Gear pump devices include a gear pump constituted of an outer gear and an inner gear meshed with each other, a seal mechanism for partitioning between a low pressure side and a high pressure side, and a case for receiving them. The seal mechanism includes an outer member, an annular rubber member and an inner member. Each member of the seal mechanism is urged in a predetermined direction by a discharge pressure. That is, due to the discharge pressure, the outer member abuts against one axial end face of the outer gear and one axial end face of the inner gear, and the inner member abuts against an inner wall surface of a housing (case), thereby exhibiting a sealing function. If the outer member is strongly pressed by the discharge pressure, a pressing force thereof against the outer gear is increased (a contact surface pressure is increased). Then, a sliding resistance is increased and thus a driving torque for the gear pump is increased. However, if a contact area between the outer member and the outer gear and inner gear is decreased in order to decrease the sliding resistance, the pressing force is reduced and thus sealing property is reduced.

Thus, for example, in Japanese Patent Application Publication No. 2016-28192, a gear pump device is disclosed, in which an abutting portion (protrusion) provided on an outer circumference of an outer member abuts against a cylinder, thereby dispersing a pressing force. As a result, a driving torque for the gear pump is reduced.

CITATION LIST

Patent Literature

PTL 1: JP-A-2016-28192

SUMMARY OF INVENTION

Technical Problem

However, in the above gear pump device, the outer member is increased in size by a size corresponding to the abutting portion, and correspondingly, a volume of a pressure chamber (discharge chamber) is decreased. Also, since an aspect, in which the cylinder receives a force, is varied depending on the shape and position of the abutting portion (protrusion), a relatively high accuracy is required for manufacturing and designing. That is, the gear pump device has room for improvement in terms of volumetric efficiency and manufacturability (ease of manufacture).

The present invention has been made keeping in mind the above problems, and an object thereof is to provide a gear pump device, which enables further improvement in volumetric efficiency and manufacturability and also makes it possible to ensure sealing property and to reduce a driving torque.

Solution to Problem

A gear pump device according to the present embodiment includes a gear pump having an outer gear and an inner gear, wherein the outer gear has an internal tooth portion and the outer gear and the inner gear are configured to be meshed with each other while forming a plurality of void portions therebetween, wherein the gear pump is configured to suck and discharge a fluid as the outer gear and the inner gear are rotated by rotation of a shaft; a case defining a receiving portion, in which the gear pump is received; and a seal mechanism arranged between the case and the gear pump and configured to partition a low pressure side, which includes a suction side of the gear pump sucking a fluid and the periphery of the shaft, and a high pressure side, which includes a discharge chamber of the gear pump allowing the fluid to be discharged therein; wherein the seal mechanism includes: an annular rubber member for sealing between the low pressure side and the high pressure side while surrounding the low pressure side; an outer member having one seal surface abutting against the annular rubber member and the other seal surface abutting against one axial end face of the outer gear and also against one axial end face of the inner gear; and an inner member having an outer circumferential wall allowing the annular rubber member to be mounted thereon and configured to be fitted in the outer member, wherein the inner member is configured to abut against an inner wall surface of the case opposite to the one axial end face of the inner gear, wherein the inner member has a notch on an axial end portion of the outer circumferential wall facing the inner gear, wherein the notch is configured to be recessed radially inward of the inner gear and thus to define a depressed part together with the one axial end face of the inner gear, wherein the outer member has an insertion part configured to be arranged in the depressed part and also to abut against the one axial end portion of the inner gear, wherein the insertion part constitutes a part of the other seal surface.

Advantageous Effects of Invention

According to the present invention, the insertion part of the outer member abutting against the one axial end face of the inner gear is inserted in the depressed part defined by the notch of the inner member and the inner gear. Since the insertion part abuts against the one axial end face of the inner gear, it is possible to secure a required contact area between the outer member and each of the one axial end face of the outer gear and the one axial end face of the inner gear, thereby obtaining a suitable seal area. Also, it is possible to reduce an area (pressure receiving surface), in which the outer member receives the discharge pressure, by an area of the insertion part arranged in the depressed part. As a result, it is possible to reduce a pressing force of the outer member against the outer gear and the inner gear. That is, it is possible to reduce a driving torque for the gear pump while ensuring sealing property of the outer member. Further, according to the present invention, the insertion part is formed on the outer member, but the notch, in which the insertion part is to be received, is formed on the inner member, thereby further improving volumetric efficiency. Further, in terms of manufacturing, the axial end portion of the member is cut out and the insertion part is formed to correspond thereto, and thus the formation position and shape thereof allow designing and manufacturing to be relatively easily performed. That is, manufacturability can be further improved.

BRIEF DESCRIPTION OF DRAWINGS

FIG. 4(*b*) is a sectional view taken along a line IVb-IVb' in FIG. 4(*a*).

FIG. 5(*b*) is a right side view of the outer member of the present embodiment.

FIG. 5(*c*) is a sectional view taken along a line Vc-Vc' in FIG. 5(*a*).

DESCRIPTION OF EMBODIMENTS

Hereinafter, embodiments of the present invention will be described with reference to the accompanying drawings. First, a basic configuration of a vehicle brake device will be described with reference to FIG. 1. Herein, an example, in which the vehicle brake device according to the present invention is applied to a vehicle having a hydraulic circuit constituted of front and rear conduits, will be described.

Figure 1:
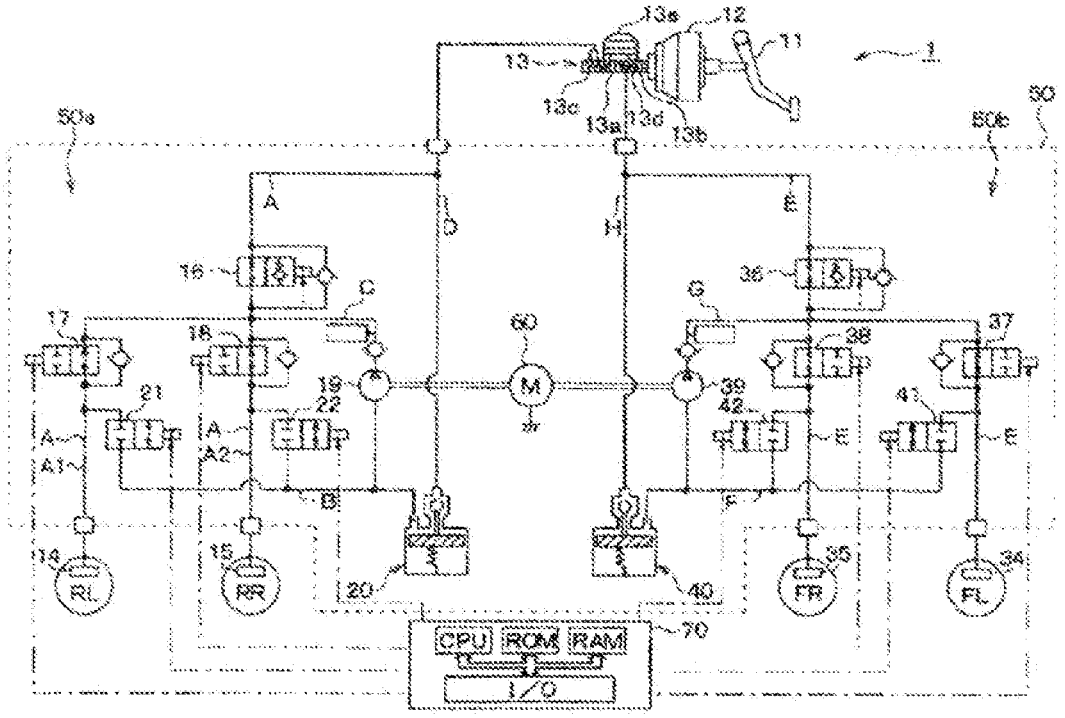
FIG. 1 is a schematic view of a vehicle brake device employing a gear pump device of the present embodiment.

In FIG. 1, if a driver treads on a brake pedal 11 as a brake operation member, a tread force is boosted by a booster 12 and then presses master pistons 13*a*, 13*b* arranged in a master cylinder (hereinafter, referred to as a M/C) 13. Thus, M/C pressures, which are the same, are respectively generated in a primary chamber 13*c* and a secondary camber 13*d*, which are partitioned by the master pistons 13*a*, 13*b*. The M/C pressure is transmitted to each of wheel cylinders (hereinafter, referred to as W/C) 14, 15, 34, 35 via an actuator 50. The M/C 13 is provided with a master reservoir 13*e* having passages communicated with the primary chamber 13*c* and the secondary camber 13*d*, respectively.

The actuator 50 has a first conduit system 50*a* and a second conduit system 50*b*. The first conduit system 50*a* is a rear system for controlling a brake fluid pressure applied to a right rear wheel RR and a left rear wheel RL, and the second conduit system 50*b* is a front system for controlling a brake fluid pressure applied to a left front wheel FL and a right front wheel FR. Since configurations of the systems 50*a*, 50*b* are the same, only the first conduit system 50*a* will be described below and the description of the second conduit system 50*b* will be omitted.

The first conduit system 50*a* has a conduit A serving as a main conduit for transmitting the M/C pressure, as described above, to the W/C 14 provided on the left rear wheel RL and the W/C 15 provided on the right rear wheel RR so as to generate a W/C pressure. Also, the conduit A is provided with a first differential pressure control valve 16 capable of being controlled to a communication state and a differential pressure state. During normal braking, at which a driver operates the brake pedal 11 (when a vehicle motion control is not being executed), the first differential pressure control valve 16 has a valve position adjusted such that the first differential pressure control valve 16 is in the communication state. The valve position of the first differential pressure control valve 16 is adjusted such that the first differential pressure control valve 16 becomes an increased differential pressure state as an electric current value flowing through a solenoid coil thereof is increased.

When the first differential pressure control valve 16 is in the differential pressure state, a brake fluid is allowed to flow only from the W/Cs 14, 15 to the M/C 13, only when a brake fluid pressure on the side of the W/Cs 14, 15 becomes larger than the M/C pressure by a predetermined value or more. Therefore, the pressure on the side of the W/Cs 14, 15 is kept not to become larger than that on the side of the M/C 13 by the predetermined value or more.

Also, the conduit A is branched into two conduits A1, A2 on the side of the W/Cs 14, 15 downstream of the first differential pressure control valve 16. The conduit A1 is provided with a first pressure increase control valve 17 for controlling an increase in brake fluid pressure to the W/C 14, and the conduit A2 is provided with a second pressure increase control valve 18 for controlling an increase in brake fluid pressure to the W/C 15.

The first and second pressure increase control valves 17, 18 are constructed by a two-position electromagnetic valve capable of being controlled to communication/interruption states. Specifically, the first and second pressure increase control valves 17, 18 are a normal open type, which is controlled to become a communication state when a control electric current flowing through a solenoid coil provided in the first and second pressure increase control valves 17, 18 becomes zero (when not energized) and also to become an interruption state when the control electric current flows through the solenoid coil (when energized).

A first pressure decrease control valve 21 and a second pressure decrease control valve 22 are respectively arranged on a conduit B serving as a pressure decrease conduit for connecting points on the conduit A, which are located between each of the first and second pressure increase control valves 17, 18 and the respective W/Cs 14, 15, with a pressure regulation reservoir 20. The first and second pressure decrease control valves 21, 22 are constructed by a two-position electromagnetic valve capable of being controlled to communication/interruption states. Also, the first and second pressure decrease control valves 21, 22 are a normal closed type.

A conduit C serving as a reflux conduit is arranged between the pressure regulation reservoir 20 and the conduit A as the main conduit. The conduit C is provided with a gear pump 19 driven by a motor 60 and configured to suck a brake fluid from the pressure regulation reservoir 20 and then to discharge the brake fluid to the side of the M/C 13 or to the side of the W/Cs 14, 15. The motor 60 is driven by controlling energization to a motor relay (not shown).

Further, a conduit D serving as an auxiliary conduit is provided between the pressure regulation reservoir 20 and the M/C 13. Through the conduit D, the gear pump 19 sucks a brake fluid from the M/C 13 and then discharges the brake fluid to the conduit A, so that during the vehicle motion control, the brake fluid is supplied to the side of the W/Cs 14, 15 and thus increases a W/C pressure of the corresponding wheels.

Meanwhile, although the first conduit system 50*a* has been described herein, the second conduit system 50*b* has the same configuration, and accordingly the second conduit system 50*b* has the same components as those provided in the first conduit system 50*a*. Specifically, the second conduit system 50*b* includes a second differential pressure control valve 36 corresponding to the first differential pressure control valve 16; third and fourth pressure increase control valves 37, 38 corresponding to the first and second pressure increase control valves 17, 18; third and fourth pressure decrease control valves 41, 42 corresponding to the first and second pressure decrease control valves 21, 22; a gear pump 39 corresponding to the gear pump 19; a pressure regulation reservoir 40 corresponding to the pressure regulation reservoir 20; and conduits E to H corresponding to the conduits A to D.

Also, a brake ECU 70 corresponds to a control system for a brake control system 1 and is constructed by a known microcomputer including CPU, ROM, RAM, I/O, and the like. The brake ECU 70 is configured to execute processing, such as various calculations, in accordance with a program stored in ROM or the like, and also to execute a vehicle motion control, such as anti-skid control. That is, the brake ECU 70 calculates various physical quantities based on detection of sensors (not shown), determines whether or not to execute a vehicle motion control based on the calculation results, and then when executing the vehicle motion control, obtains a control quantity for a wheel to be controlled, i.e., a W/C pressure to be generated in the W/C of the wheel to be controlled. On the basis of the results, the brake ECU 70 executes control of current supply to each of the control valves 16 to 18, 21, 22, 36 to 38, 41, 42 and also control of an current amount of the motor 60 for driving the gear pumps 19, 39, thereby controlling the W/C pressure of the wheel to be controlled. As a result, the vehicle motion control is performed.

For example, when a pressure cannot be generated in the M/C 13 as in traction control or anti-skid control, the gear pumps 19, 39 are driven and also the first and second differential pressure control valves 16, 36 are brought into the differential pressure state. As a result, a brake fluid is supplied to downstream sides of the first and second differential pressure control valves 16, 36, i.e., to the sides of the W/Cs 14, 15, 34, 35 through the conduits D, H. Then, by suitably controlling the first to fourth pressure increase control valves 17, 18, 37, 38 or the first to fourth pressure decrease control valves, 21, 22, 41, 42, the W/C pressure of the wheel to be controlled is controlled to be increased or decreased, so that the W/C pressure becomes a desired control quantity.

Also, during anti-skid (ABS) control, the first to fourth pressure increase control valves 17, 18, 37, 38 or the first to fourth pressure decrease control valves, 21, 22, 41, 42 are suitably controlled and also the gear pumps 19, 39 are driven, thereby controlling the W/C pressure to be increased or decreased. As a result, the W/C pressure is controlled to become a desired control quantity.

Figure 2:
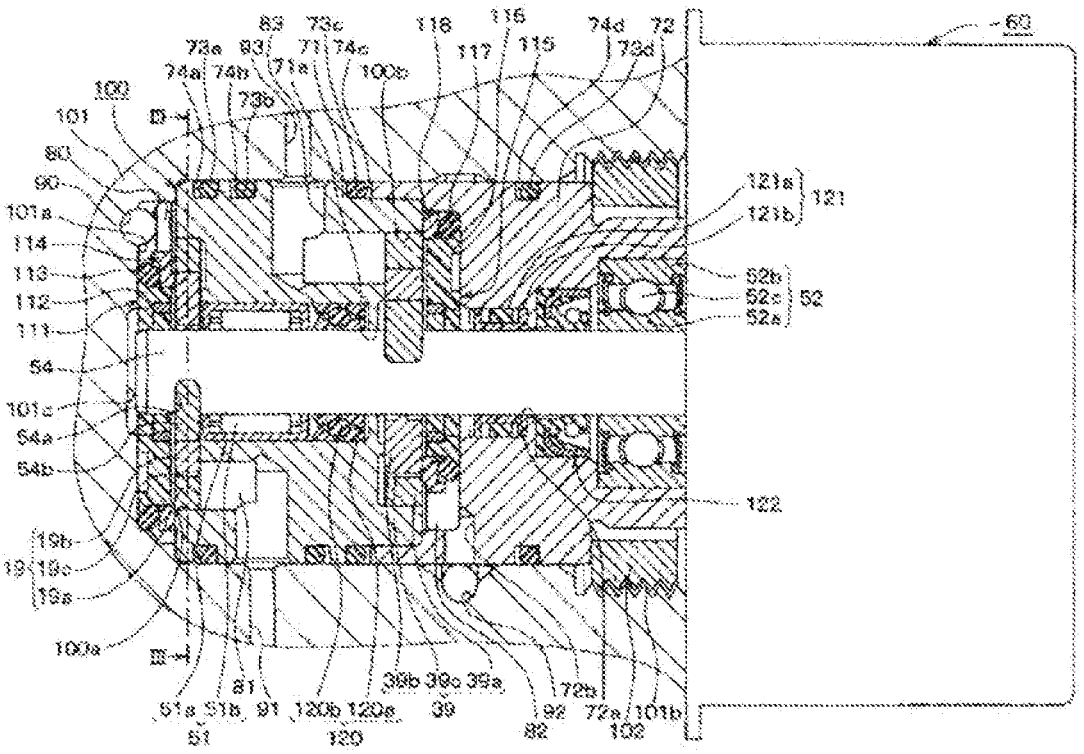
FIG. 2 is a sectional view of the gear pump device of the present embodiment.
Figure 3:
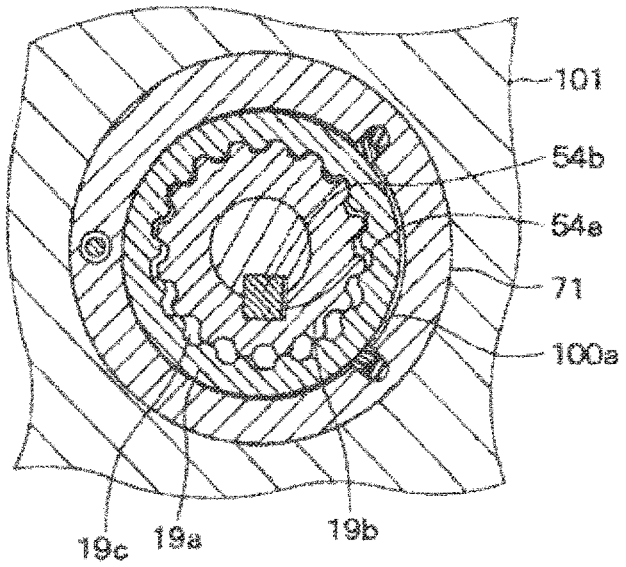
FIG. 3 is a sectional view taken along a line III-III in FIG. 2.
Figure 4A:
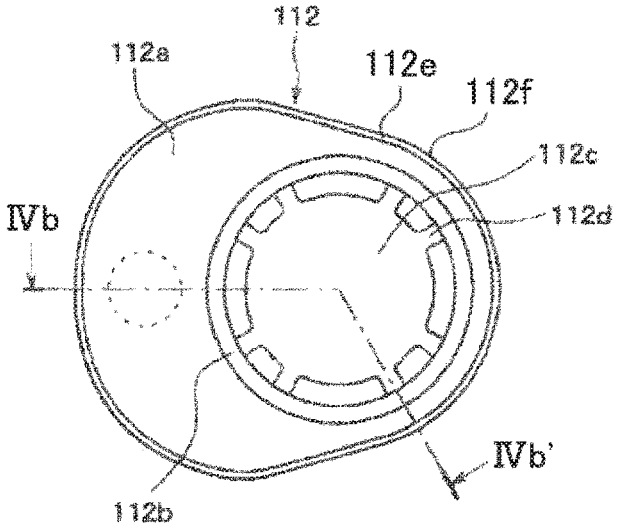
FIG. 4(*a*) is a front view of an inner member of the present embodiment.
Figure 4B:
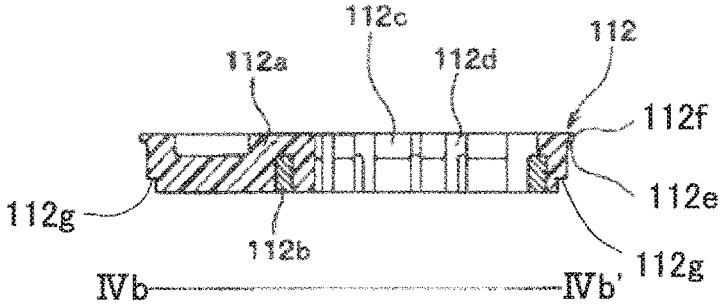
Figure 5A:
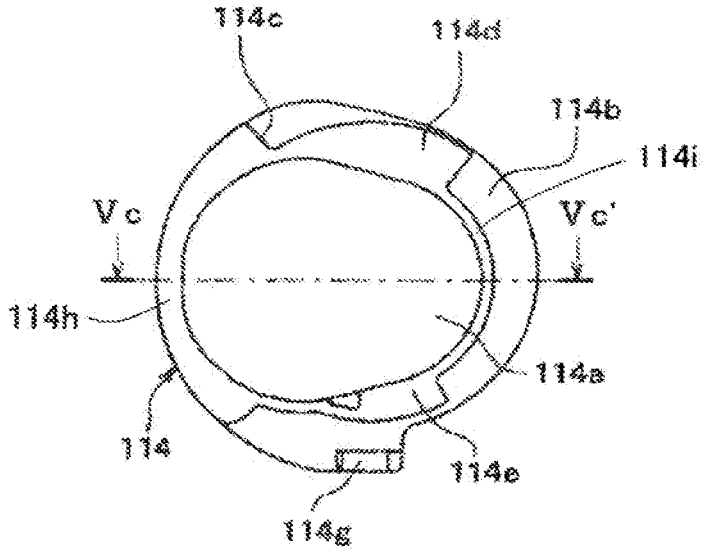
FIG. 5(*a*) is a front view of an outer member of the present embodiment.
Figure 5B:
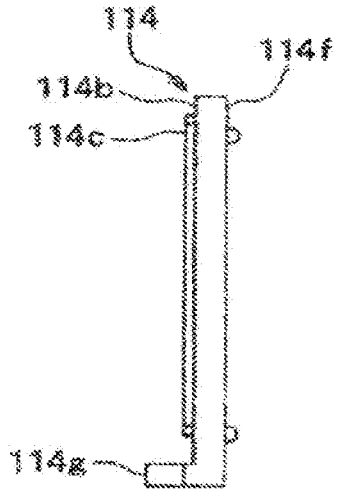
Figure 5C:
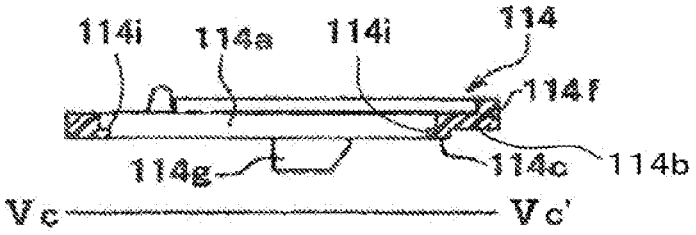
Figure 6:
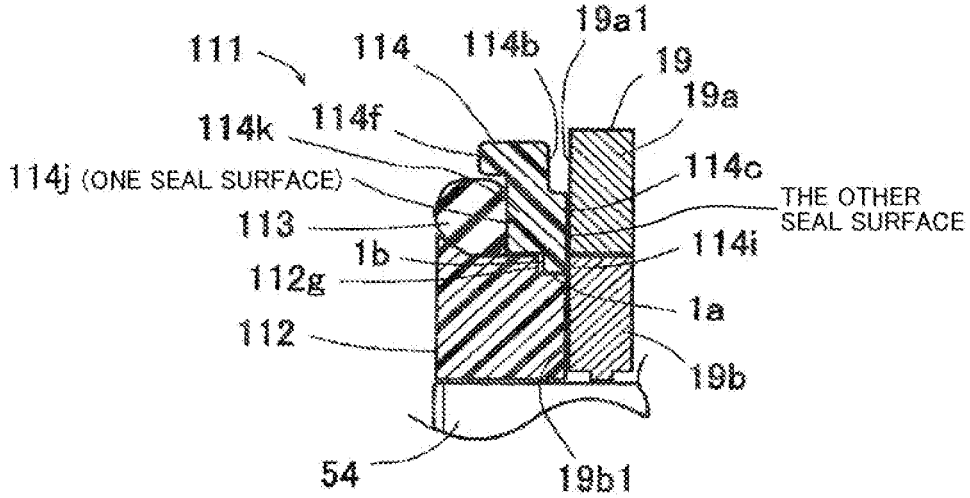
FIG. 6 is a schematic sectional view of a seal mechanism and a gear pump of the present embodiment.

Next, the detailed structure of a gear pump device of the vehicle brake device configured as described above will be described with reference to FIGS. 2 and 3. FIG. 2 shows a state where a pump main body 100 is mounted on a housing 101 of the actuator 50. For example, the pump main body 100 is attached such that a vertical direction on the paper surface is a vertical direction of a vehicle. Meanwhile, in the representation of the figures, a seal mechanism in FIG. 2 is represented in a conventional shape, and seal mechanisms shown in FIGS. 4 to 6 are seal mechanisms 111, 115 of the present embodiment.

As described above, the vehicle brake device is constituted of the first conduit system 50*a* and the second conduit system 50*b*. Therefore, the pump main body 100 is provided with two gear pumps, including the gear pump 19 for the first conduit system 50*a* and the gear pump 39 for the second conduit system 50*b*.

The gear pumps 19, 39 built in the pump main body 100 are driven by rotating a rotational shaft 54, which is supported on a first bearing 51 and a second bearing 52, using the motor 60. A casing defining an exterior shape of the pump main body 100 has a cylinder 71 and a plug 72, which are made of aluminum. The first bearing 51 has an outer ring 51*a* and needle rollers 51*b*. The second bearing 52 has an inner ring 52*a*, an outer ring 52*b* and rolling elements 52*c*. The first bearing 51 is arranged in the cylinder 71 and the second bearing 52 is arranged in the plug 72.

The casing of the pump main body 100 is constructed by press-fitting and integrating one end of the cylinder 71 into the plug 72 while the cylinder 71 is coaxially arranged with the plug 72. Also, the pump main body 100 is constructed by equipping therein the gear pumps 19, 39, various seal members and the like, in addition to the cylinder 71 and the plug 72.

In this way, the pump main body 100 is constructed to have an integral structure. The pump main body 100 formed in such an integral structure is inserted into a generally cylindrical recess portion 101*a*, which is formed in the housing 101 made of aluminum, from a right direction on the paper surface. Also, a ring-shaped male thread member (screw) 102 is screwed with a female thread groove 101*b* formed in an inlet of the recess portion 101*a*, thereby fixing the pump main body 100 to the housing 101. Due to screwing of the male thread member 102, the pump main body 100 is prevented from falling out of the housing 101.

Hereinafter, a direction, in which the pump main body 100 is inserted into the recess portion 101*a* of the housing 101, is simply referred to as an insertion direction. Also, an axial direction of the pump main body 100 (corresponding to an axial direction of the rotational shaft 54) is referred to as a pump axial direction or simply an axial direction; a circumferential direction of the pump main body 100 (corresponding to a circumferential direction of the rotational shaft 54) is referred to as a pump circumferential direction or simply a circumferential direction; and a radial direction of the pump main body 100 (corresponding to a radial direction of the rotational shaft 54) is referred to as a pump radial direction or simply a radial direction.

Also, a second circular recess portion 101*c* is formed at a location in the recess portion 101*a* of the housing 101, which corresponds to a distal end of the rotational shaft 54 (left end in FIG. 2), among distal end locations forward in the insertion direction. A diameter of the second recess portion 101*c* is larger than a diameter of the rotational shaft 54 and the distal end of the rotational shaft 54 is positioned in the second recess portion 101*c*. As a result, the rotational shaft 54 is configured so as not to be in contact with the housing 101.

The cylinder 71 and the plug 72 are provided with center holes 71*a*, 72*a*, respectively. The rotational shaft 54 is inserted in the center holes 71*a*, 72*a* and also supported by the first bearing 51 fixed on an inner circumference of the center hole 71*a* formed in the cylinder 71 and the second bearing 52 fixed on an inner circumference of the center hole 72*a* formed in the plug 72. The gear pumps 19, 39 are respectively equipped on both sides of the first bearing 51, i.e., in a region, which is located in front of the first bearing 51 in the insertion direction, and a region, which is located between the first bearing 51 and the second bearing 52.

The gear pump 19 is arranged in a gear chamber (corresponding to a "receiving portion") 100*a* constructed by a circular counterbore recessed in one end face of the cylinder 71 and is configured as an internal gear pump (trochoid pump) driven by the rotational shaft 54 inserted through the gear chamber 100*a*. The housing 101 and the cylinder 71 correspond to the casing.

Specifically, the gear pump 19 has a rotational part constituted of an outer gear 19*a* having an internal tooth portion formed on an inner circumference thereof and an inner gear 19*b* having an external tooth portion formed on an outer circumference thereof and is configured such that the rotational shaft 54 is inserted through a hole formed at the center of the inner gear 19*b*. Also, a key 54*b* is fitted in a hole 54*a* formed in the rotational shaft 54, and thus a torque can be transmitted to the inner gear 19*b* via the key 54*b*.

The internal tooth portion and the external tooth portion formed respectively on the outer gear 19*a* and the inner gear 19*b* are meshed with each other to define a plurality of void portions 19*c* therebetween. Also, the void portions 19*c* are varied in size by rotation of the rotational shaft 54, thereby causing a brake fluid to be sucked or discharged.

On the other hand, the gear pump 39 is arranged in a gear chamber (receiving portion) 100*b* constructed by a circular counterbore recessed in the other end face of the cylinder 71 and is driven by the rotational shaft 54 inserted through the gear chamber 100*b*. Like the gear pump 19, the gear pump 39 has an outer gear 39*a* and an inner gear 39*b* and is constructed as an internal gear pump, in which a brake fluid is sucked or discharged by a plurality of void portions 39*c* formed by tooth portions thereof meshed with each other. The gear pump 39 is arranged as if the gear pump 19 is rotated by approximately 180° about the rotational shaft 54. Due to this arrangement, the suction-side void portions 19*c*, 39*c* and the discharge-side void portions 19*c*, 39*c* of each of the gear pumps 19, 39 are symmetrically positioned with respect to the rotational shaft 54, so that forces exerted on the rotational shaft 54 by a brake fluid pressure on the discharge sides, which is a high pressure, can cancel out each other. The gear pumps, 19, 39 basically have the same structure, but thicknesses thereof in the pump axial direction are different from each other in order to make suction and discharge amounts thereof different from each other.

On the one end face side of the cylinder 71, the seal mechanism 111 for urging the gear pump 19 toward the cylinder 71 is provided on a side of the gear pump 19 opposite to the cylinder 71, i.e., between the cylinder 71 and gear pump 19, and the housing 101. Also, on the other end face side of the cylinder 71, the seal mechanism 115 for urging the gear pump 39 toward the cylinder 71 is provided on a side of the gear pump 39 opposite to the cylinder 71, i.e., between the cylinder 71 and gear pump 39, and the plug 72.

The seal mechanism 111 is configured as a ring-shaped member having a hollow portion allowing the rotational shaft 54 to be inserted therein and presses the outer gear 19*a* and the inner gear 19*b* toward the cylinder 71. As a result, the seal mechanism 111 is configured to seal between a relatively low pressure portion and a relatively high pressure portion on one end face side of the gear pump 19. Specifically, the seal mechanism 111 exhibits a sealing function by abutting against a bottom surface of the recess portion 101*a*, which corresponds to an outskirts of the housing 101, and also against a desired location on the outer gear 19*a* or the inner gear 19*b*.

The seal mechanism 111 is constituted of a hollow frame-shaped inner member 112, an annular rubber member 113 and a hollow frame-shaped outer member 114. The inner member 112 is fitted in the outer member 114 with the annular rubber member 113 arranged between an outer circumferential wall of the inner member 112 and an inner circumferential wall of the outer member 114.

Next, a configuration of each of components 112 to 114 constituting the seal mechanism 111 will be described with reference to FIGS. 4 and 5. As shown in FIG. 4, the inner member 112 is constituted of a resin portion 112*a* and a metal ring 112*b*. The resin portion 112*a* and the metal ring 112*b* are integrated with each other by integrally molding (insert-molding) the metal ring 112*b* during molding of the resin portion 112*a*.

The resin portion 112*a* has a hollow frame shape, in which a hollow portion 112*c* is formed to allow the rotational shaft 54 to be arranged therein. Herein, the hollow portion 112*c* has a plurality of slits 112*d* formed along the pump axial direction so that a diameter thereof is partially expanded relative to the rotational shaft 54, although the hollow portion 112*c* may have a circular shape to conform to an outer circumferential shape of the rotational shaft 54. The metal ring 112*b* is concentrically arranged with the hollow portion 112*c*. The metal ring 112*b* is provided to reinforce the resin portion 112*a*, including the periphery of the hollow portion 112*c*.

Also, a part of the resin portion 112*a*, in which no slit 112*d* is formed, protrudes inward of the metal ring 112*b*, and a part thereof, in which the slits 112*d* are formed, is recessed up to a location of the metal ring 112*b*. In addition, a distance from a part of an inner wall surface of the hollow portion 112*c*, which is not the slits 112*d*, to the center of the hollow portion 112*c* is equal to a radius of the rotational shaft 54.

In the case of this structure, a part of the inner member 112, which becomes a sliding surface relative to the rotational shaft 54, is the part of the hollow portion 112*c*, in which no slit 112*d* is formed, thereby preventing the metal ring 112*b* from coming in contact with the rotational shaft 54. If the inner wall surface of the hollow portion 112*c* is constructed by the metal ring 112*b* and also serves as a surface abutting against the rotational shaft 54, it is possible to position the rotational shaft 54 in the pump radial direction by adjusting a gap between an outer circumferential surface of the rotational shaft 54 and the inner wall surface of the hollow portion 112*c* in accordance with a dimensional tolerance of the metal ring 112*b*.

An exterior shape of the inner member 112 is configured to have a radius smaller than that of the void portions 19*c* at a location thereon, which corresponds to the right side on the paper surface of FIG. 4(*a*), i.e., the discharge side of the gear pump 19, which has a high pressure, and also to have a radius larger than that of the void portions 19*c* at a location thereon, which corresponds to the left side on the paper surface, i.e., the suction side of the gear pump 19, which has a low pressure. Therefore, when the annular rubber member 113 is fitted onto the outer circumferential wall of the inner member 112, the periphery of the rotational shaft 54 or the suction side of the gear pump 19, which has a low pressure, is positioned inward of the annular rubber member 113, whereas the discharge side of the gear pump 19, which has a high pressure, is positioned outward of the annular rubber member 113.

Also, when the gear pump 19 sucks and discharges a brake fluid, a discharge pressure, which is a high pressure, is applied to the annular rubber member 113 and thus the annular rubber member 113 is pressed against the outer circumferential wall of the inner member 112 inward in the pump radial direction. Therefore, the outer circumferential wall of the inner member 112 serves as a pressure receiving surface receiving a pressure from the annular rubber member 113 inward in the pump radial direction. The pressure receiving surface is configured to generate a propulsive force in a direction moving the inner member 112 away from the gear pump 19 in the pump axial direction. In the present embodiment, a part of the pressure receiving surface is formed as a tapered surface 112*e*. Specifically, a flange portion (collar portion) 112*f* extending around the outer circumferential wall of the inner member 112 is provided on a side of the outer circumferential wall of the inner member 112 opposite to the gear pump 19 (on a side thereof away from the gear pump 19), and also a surface of the flange portion 112*f* facing the gear pump 19 is formed as the tapered surface 112*e*. Also, as described below, the inner member 112 has a notch 112*g* extending around the outer circumferential wall at an end portion of the outer circumferential wall near to the gear pump 19.

The annular rubber member 113 is constructed by an O-ring or the like and is configured to be fitted on the outer circumferential wall of the inner member 112 and thus to be arranged between the inner member 112 and the outer member 114. The annular rubber member 113 is configured to have an increased contact pressure against the receiving pressure surface of the inner member 112 in accordance with an increase in discharge pressure during driving of the gear pump 19, and also to seal between the discharge side of the gear pump 19, which has a high pressure, and the periphery of the rotational shaft 54 or the suction side of the gear pump 19, which have a low pressure, by abutting against the bottom surface (corresponding to an "inner wall surface") of the recess portion 101*a*. The annular rubber member 113 may be formed in a shape following the exterior shape of the inner member 112. However, it is preferable that the annular rubber member 113 having a circular shape is elastically deformed to conform to the exterior shape of the inner member 112 and then to be fitted onto the outer circumferential wall of the inner member 112.

The outer member 114 is configured to seal between a low pressure side and a high pressure side on a pump-axial end face of the gear pump 19. As shown in FIGS. 5(*a*) to 5(*c*), the outer member 114 is formed in a hollow frame shape, and an interior shape of a hollow part 114*a* thereof is configured to correspond to the exterior shape of the inner member 112. Also, the outer member 114 is constructed by a stepped plate having a recess part 114*b* and a protrusion part 114*c* formed on an end face thereof facing the gear pump 19, and the protrusion part 114*c* is configured to abut against one end face of both gears 19*a*, 19*b* or one end face of the cylinder 71.

The protrusion part 114*c* has a first sealing part 114*d*, a second sealing part 114*e* and a third sealing part 114*h*. The first sealing part 114*d* and the second sealing part 114*e* are respectively provided at a site, over which the void portions 19*c* are transited from a communication state with a suction port 81 (as described below) to a communication state with a discharge chamber 80 (as described below), and at a site, over which the void portions 19*c* are transited from the communication state with the discharge chamber 80 to the communication state with the suction portion 81. That is, the first sealing part 114*d* is arranged at a site corresponding to a part of the plurality of void portions 19*c*, which has the largest volume, and the second sealing part 114*e* is arranged at a site corresponding to a part of the plurality of void portions 19*c*, which has the smallest volume. The sealing parts 114*d*, 114*e* are configured to abut against the one end face of both gears 19*a*, 19*b*, thereby sealing the void portions 19*c* and also sealing between the low pressure side and the high pressure side thereon. The third sealing part 114*h* is a portion located between the first sealing part 114*d* and the second sealing part 114*e* and is configured to abut against the one end face of the cylinder 71, thereby sealing between the low pressure side and the high pressure side thereon.

The recess part 114*b* is communicated with the discharge chamber 80, thereby allowing a discharge pressure, which is a high pressure, to be introduced therein. Therefore, when the gear pump 19 discharges a high pressure, the high discharge pressure is introduced to the outer circumference of the outer member 114 including the inside of the recess part 114*b*. Due to the discharge pressure, there is a possibility that the outer member 114 is deformed and clamps the inner member 112.

Also, the inner member 112 and the annular rubber member 113 are fitted into the outer member 114 from a side thereof opposite to the gear pump 19. A protruding wall 114*f* having a shape corresponding to the annular rubber member 113 is formed on an end face 114*j* of the outer member 114 opposite to the gear pump 19 (end face 114*j* away from the gear pump 19). The annular rubber member 113 is arranged to face an inner circumferential wall of the protruding wall 114*f*. As a result, the outer member 114 is accurately aligned with the inner member 112 and the annular rubber member 113.

In addition, a protrusion-shaped anti-rotation part 114*g* is formed at a site on an end face of the outer member 114 facing the gear pump 19, which is located outward of the protrusion part 114*c* in the pump radial direction (see FIG. 5(*c*)). The anti-rotation part 114*g* is inserted in a recess portion (not shown) formed in the cylinder 71, thereby preventing the outer member 114 from rotating relative to the cylinder 71.

As shown in FIG. 2, an outer diameter of the seal mechanism 111 is set to be smaller than an inner diameter of the recess portion 101*a* of the housing 101 at least on the left side on the paper surface of FIG. 2. Therefore, the seal mechanism 111 is configured to allow a brake fluid to flow through a gap between the seal mechanism 111 and the recess portion 101*a* of the housing 101 on the left side on the paper surface. The gap forms the discharge chamber 80 and thus is connected to a discharge conduit 90 formed in the bottom of the recess portion 101*a* of the housing 101. Due to this structure, the gear pump 19 can discharge a brake fluid through the discharge chamber 80 and the discharge conduit 90 as a discharge path.

In the cylinder 71, the suction port 81 is formed to be communicated with suction-side void portions 19*c* of the gear pump 19. The suction port 81 extends from an end face of the cylinder 71 facing the gear pump 19 up to an outer circumferential surface thereof and is connected to a suction conduit 91 provided on a side surface of the recess portion 101*a* of the housing 101. Due to this structure, the gear pump 19 can introduce a brake fluid through the suction conduit 91 and the suction port 81 as a suction path.

On the other hand, the seal mechanism 115 is also constructed by a ring-shaped member having a center portion allowing the rotational shaft 54 to be inserted therein and presses the outer gear 39*a* and the inner gear 39*b* toward the cylinder 71, thereby sealing between a relatively low pressure portion and a relatively high pressure portion on one end face side of the gear pump 39. Specifically, the seal mechanism 115 exhibits a sealing function by abutting against an end face of a part of the plug 72, in which the seal mechanism 115 is received, and also against a desired location on the outer gear 39*a* or the inner gear 39*b*.

The seal mechanism 115 is also constituted of a hollow frame-shaped inner member 116, an annular rubber member 117 and a hollow frame-shaped outer member 118. The inner member 116 is fitted in the outer member 118 with the annular rubber member 117 arranged between an outer circumferential wall of the inner member 116 and an inner circumferential wall of the outer member 118. The seal mechanism 115 is different from the seal mechanism 111 as described above, in that a surface thereof forming a seal is reverse to that of the seal mechanism 111. Therefore, the seal mechanism 115 is formed in a shape symmetric to the seal mechanism 111, but is arranged to have a phase offset from the seal mechanism 111 by 180° about the rotational shaft 54. However, the basic structure of the seal mechanism 115 is the same as that of the seal mechanism 111, and accordingly the detailed structure of the seal mechanism 115 will not be described.

Meanwhile, an outer diameter of the seal mechanism 115 is set to be smaller than an inner diameter of the plug 72 at least on the right side on the paper surface. Therefore, the seal mechanism 115 is configured to allow a brake fluid to flow through a gap between the seal mechanism 115 and the plug 72 on the right side on the paper surface. The gap forms a discharge chamber 82 and thus is connected to a communication passage 72*b* formed in the plug 72 and a discharge conduit 92 formed in the side surface of the recess portion 101*a* of the housing 101. Due to this structure, the gear pump 39 can discharge a brake fluid through the discharge chamber 82, the communication passage 72*b* and the discharge conduit 92 as a discharge path.

Meanwhile, end faces of the cylinder 71 facing the gear pumps 19, 29, respectively, become seal surfaces too. Therefore, the gear pumps 19, 39 come in tight contact with the seal surfaces, respectively, to form mechanical seals, thereby sealing between a relatively low pressure portion and a relatively high pressure portion on the other end face side of the gear pumps 19, 39.

Further, in the cylinder 71, a suction port 83 is formed to be communicated with the suction-side void portions 39*c* of the gear pump 39. The suction port 83 extends from an end face of the cylinder 71 facing the gear pump 39 up to an outer circumferential surface thereof and is connected to a suction conduit 93 provided on a side surface of the recess portion 101*a* of the housing 101. Due to this structure, the gear pump 39 can introduce a brake fluid through the suction conduit 93 and the suction port 83 as a suction path. Meanwhile, the suction conduit 91 and the discharge conduit 90 in FIG. 2 correspond to the conduit C in FIG. 1, and also the suction conduit 93 and the discharge conduit 92 correspond to the conduit G in FIG. 1.

Further, a seal member 120 constituted of an annular resin member 120*a* and an annular rubber member 120*b* is received in a part of the center hole 71*a* of the cylinder 71, which is located rearward of the first bearing 51 in the insertion direction. As a result, sealing between two conduit systems in the center hole 71*a* of the cylinder 71 is obtained. In the center hole 72*a* of the plug 72, which has a stepped shape, a seal member 121 constituted of an elastic ring 121*a* and a ring-shaped resin member 121*b* is received therein. Due to an elastic force of the elastic ring 121*a*, the resin member 121*b* is pressed to come in contact with the rotational shaft 54.

Further, the diameter of the center hole 72*a* of the plug 72 is partially enlarged even on a rearward side thereof in the insertion direction, and this portion is equipped with an oil seal (seal member) 122. Also, on the outer circumference of the pump main body 100, O-rings 73*a* to 73*d* as an annular seal member are provided to seal each of parts thereon. In order to allow the O-rings 73*a* to 73*d* to be arranged, groove portions 74*a* to 74*d* are provided on the outer circumference of the pump main body 100.

The gear pump device configured as described above performs a pumping operation for sucking and discharging a brake fluid as the rotational shaft 54 of the gear pumps 19, 39 built therein is rotated by the motor 60. As a result, the vehicle motion control, such as anti-skid control, is performed by the vehicle brake device.

Also, in the gear pump device, a discharge pressure of each of the gear pumps 19, 39 is introduced into the discharge chambers 80, 82, respectively, in accordance with the pumping operation. At as a result, the discharge pressure, which is a high pressure, is applied to the end face of each of the outer members 114, 118 of both the seal mechanisms 111, 115, which is opposite to the gear pumps 19, 39, respectively. Therefore, the high discharge pressure is applied to press the outer members 114, 118 toward the cylinder 71, so that seal surfaces of the outer members 114, 118 (distal surface of the protrusion part 114*c* in the case of the seal mechanism 111) are pressed against the gear pumps 19, 39, thereby pressing the other pump-axial end face of the gear pumps 19, 39 against the cylinder 71. As a result, the one pump-axial end face of the gear pumps 19, 39 is sealed by both the seal mechanisms 111, 115, and the other pump-axial end face of the gear pumps 19, 39 is mechanically sealed by the cylinder 71.

Also, if the discharge pressure of each of the gear pumps 19, 39 is introduced into the discharge chambers 80, 82, respectively, in accordance with pumping operation, the annular rubber members 113, 117 press the pressure receiving surfaces of the inner members 111, 116, respectively, in a normal direction thereto due to the discharge pressure. Then, the pressure receiving surface of the inner member 112 is pressed in the normal direction thereto, and thus a propulsive force is generated to move the inner member 112 away from the gear pump 19, so that the inner member 112 is caused to abut against the bottom surface of the recess portion 101*a*, thereby eliminating a gap therebetween. The same is true for the inner member 116. That is, the pressure receiving surface of the inner member 116 is pressed in the normal direction thereto, and thus a propulsive force is generated to move the inner member 116 away from the gear pump 39, so that the inner member 116 is caused to abut against the end face of the plug 72, thereby eliminating a gap therebetween.

Also, the annular rubber members 113, 117 are pressed against the bottom surface of the recess portion 101*a* or the end face of the plug 72 due to the high discharge pressure. Therefore, the annular rubber member 113 and the inner member 112 can seal between a low pressure side inward of the annular rubber member 113 and a high pressure side outward thereof. Also, the annular rubber member 117 and the inner member 116 can seal between a low pressure side inward of the annular rubber member 117 and a high pressure side outward thereof.

In this way, by causing the inner members 112, 116 to abut against the bottom surface of the recess portion 101*a* or the end face of the plug 72, it is possible to eliminate a gap therebetween and also to accurately seal between the low pressure side and the high pressure side.

The gear pump device of the present embodiment includes the gear pump 19 having the outer gear 19*a* and the inner gear 19*b*, wherein the outer gear 19*a* has an internal tooth portion and the outer gear 19*a* and the inner gear 19*b* are configured to be meshed with each other while forming a plurality of void portions 19*c* therebetween, wherein the gear pump 19 is configured to suck and discharge a fluid as the outer gear 19*a* and the inner gear 19*b* are rotated by rotation of the shaft 54; the cylinder 71 and the housing 101 defining the receiving portion 100*a*, in which the gear pump 19 is received; and the seal mechanism 111 arranged between the cylinder 71 and the housing 101 and the gear pump 19 and configured to partition a low pressure side, which includes a suction side of the gear pump 19 sucking a fluid and the periphery of the shaft 54, and a high pressure side, which includes the discharge chamber 80 of the gear pump 19 allowing the fluid to be discharged therein; wherein the seal mechanism 111 includes the annular rubber member 113 for sealing between the low pressure side and the high pressure side while surrounding the low pressure side; the outer member 114 having the one seal surface 114*j* abutting against the annular rubber member 113 and the other seal surface (end face of the protrusion part 114*c*) abutting against one axial end face of the outer gear 19*a* and also against one axial end face of the inner gear 19*b*; and the inner member 112 having an outer circumferential wall allowing the annular rubber member 113 to be mounted thereon and configured to be fitted in the outer member 114 (in an inner circumference thereof), wherein the inner member 112 is configured to abut against an inner wall surface of the cylinder 71 and the housing 101 opposite to the one axial end face of the inner gear 19*b* (inner wall surface opposite to the gear pump 19).

(Features of Seal Mechanism)

Figure 7:
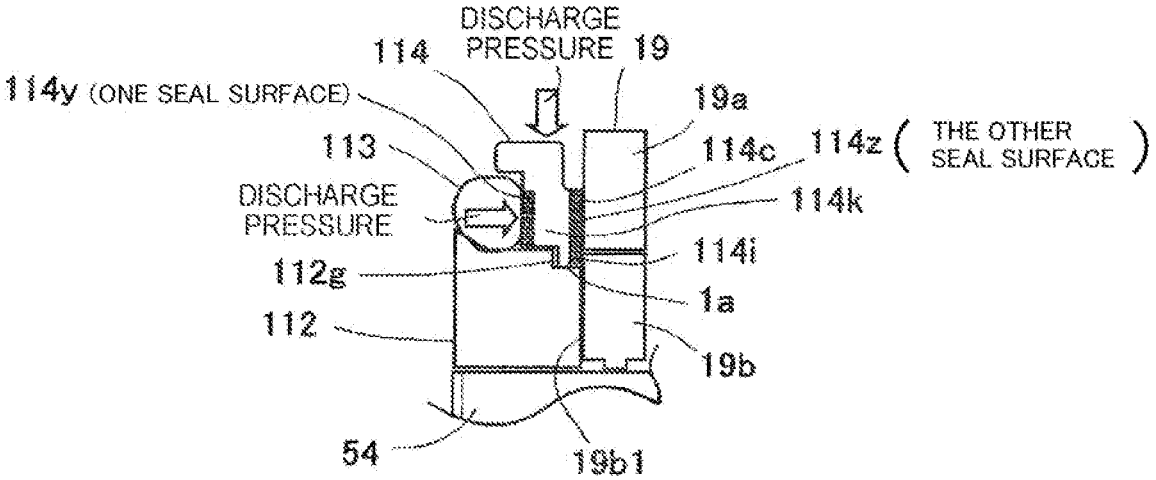
FIG. 7 is a conceptual diagram explaining a discharge pressure exerted on the outer member of the present embedment.

Now, features of the seal mechanism 111 of the present embodiment will be described with reference to FIGS. 6 and 7. Meanwhile, the seal mechanism 115 has the same configuration, and accordingly, the description thereof will be omitted. Also, FIGS. 6 and 7 are a conceptual diagram showing a cross section (schematic sectional view), where lines which are visible behind the cross section are omitted.

As shown in FIG. 6, the inner member 112 has the notch 112*g* on an axial end portion of the outer circumferential wall thereof facing the inner gear 19*b*. The notch 112*g* is configured to be recessed radially inward of the inner gear 19*b* and thus to define a depressed part 1*a* together with one axial end face 19*b*1 of the inner gear 19*b*. The notch 112*g* is an annular stepped portion (depressed part) formed by cutting out an axial edge portion of the outer circumferential wall of the inner member 112 continuously over the entire periphery thereof (to extend therearound). That is, the notch 112*g* is an annular portion of the inner member 112, which is continuously formed over the entire periphery of the outer circumferential wall of the inner member 112. One axial part of the inner member 112 is formed in a step shape by the notch 112*g*. If the inner member 112 is arranged against the gear pump 19, the depressed part 1*a* (also referred to as an annular groove or annular recess) is defined by the notch 112*g* and the one axial end face 19*b*1. The one axial end face 19*b*1 of the inner gear 19*b* forms one side surface of the depressed part 1*a*.

The outer member 114 has an insertion part 114*i* configured to be arranged in the depressed part 1*a* and also to abut against the one axial end face 19*b*1 of the inner gear 19*b*. That is, the insertion part 114*i* constitutes a part of a seal surface of the outer member 114 (corresponding to "the other seal surface") configured to abut against and seal the gear pump 19. The insertion part 114*i* is inserted in the depressed part 1*a*. The insertion part 114*i* is an annular portion of the outer member 114 (herein, an annular protrusion portion), which is continuously formed over the entire periphery on the inner circumference (inner circumferential wall) of the outer member 114. The insertion part 114*i* protrudes inward in the pump-radial direction from an axial end portion (edge portion) of the inner circumferential wall of the outer member 114 facing the inner gear 19*b*. The insertion part 114*i* can also be referred to as an annular protrusion portion extending around the inner circumferential wall.

A length of the insertion part 114*i* in the pump axial direction is smaller than a length in the pump axial direction from the end face 114*j* (corresponding to "the one seal surface") abutting against the annular rubber member 113 to a distal end face of the protrusion part 114*c* (a part of the other seal surface). A clearance 1*b* is defined between the insertion part 114*i* and the notch 112*g*. The clearance 1*b* is isolated from the high pressure side (high pressure region) by the annular rubber member 113 and thus is kept at a low pressure. The insertion part 114*i* is formed to be inserted in the depressed part 1*a* with the clearance 1*b* defined therebetween.

The outer member 114 externally includes the protrusion part 114*c* forming a part of an abutting surface against the gear pump 19 and configured to partition the low pressure side (low pressure region) and the high pressure side (high pressure region); a base part 114*k* serving as a base portion, from which the protrusion part 114*c* protrudes, and forming a part of the end face 114*j* away from the gear pump 19; the recess part 114*b* located on an outer circumference side of the base part 114*k* and configured so as not to abut against the gear pump 19; the protruding wall 114*f* protruding from the outer circumference-side end portion of the recess part 114*b* in a direction away from the gear pump 19; and the insertion part 114*i* forming a part of the abutting surface against the gear pump 19 and protruding inward from an inner circumference-side end portion of the protrusion part 114*c*.

That is, as shown in FIG. 7, an end face 114*z* (hatched region) of the outer member 114 facing the gear pump 19, which abuts against the gear pump 19 and thus serves as a seal surface, is constructed by the protrusion part 114*c* and the insertion part 114*i*. Also, a surface 114*y* (hatched region) of the outer member 114, on which a pressing force against the gear pump 19 due to a discharge pressure is exerted, is formed by the base part 114*k*. The recess part 114*b* and the protruding wall 114*f* receive the discharge pressure from both sides in the pump axial direction, and accordingly forces due to the discharge pressure are cancelled out each other. The outer member 114 receives the discharge pressure directly or via the annular rubber member 113. Due to the discharge fluid having a high pressure, the annular rubber member 113 is pushed and crushed against the recess portion 101*a* of the housing 101, the outer circumferential wall of the inner member 112 and the end face 114*j* of the outer member 114, thereby exhibiting sealing property. The protrusion part 114*c*, the base part 114*k* and the insertion part 114*i* can also be referred to as a sealing portion in the outer member 114.

According to the present embodiment, the insertion part 114*i* abutting against the one axial end face 19*b*1 of the inner gear 19*b* is inserted in the depressed part 1*a* defined by the notch 112*g* of the inner member 112 and the inner gear 19*b*. Since the insertion part 114*i* abuts against the inner gear 19*b*, it is possible to secure a required contact area between the outer member 114 and the one axial end face of the gear pump 19 (one axial end face 19*a*1 of the outer gear 19*a* and one axial end face 19*b*1 of the inner gear 19*b*). In order to ensure a required sealing property, it is first necessary to secure a predetermined contact area.

Also, it is possible to reduce an area of the surface (excluding the canceled portion) 114*y*, in which the outer member 114 receives the discharge pressure in the pump axial direction, i.e., an area of an end face of the base part 114*k* by an area of the insertion part 114*i* arranged in the depressed part 1*a*. As a result, it is possible to reduce a pressing force of the outer member 114 against the gear pump 19. If the pressing force is reduced, a sliding resistance between the outer member 114 and the gear pump 19 is reduced and thus a required driving torque is also reduced. In this way, according to the present embodiment, sealing property (contact area) can be ensured by the insertion part 114*i* and also the pressing force due to the discharge pressure can be reduced by arranging a part of the outer member 114 (insertion part 114*i*) in the depressed part 1*a*. That is, according to the present embodiment, it is possible to reduce a driving torque for the gear pump 19 while ensuring sealing property of the outer member 114. However, in order to ensure sealing property, a predetermined contact area and a predetermined pressure receiving area (pressing force) are required. Therefore, all of the protrusion part 114*c*, the base part 114*k* and the insertion part 114*i* cannot be arranged in the depressed part 1*a*, and thus the protrusion part 114*c* and the base part 114*k* need to have a suitable radial width.

Further, according to the present embodiment, the insertion part 114*i* is formed on the outer member 114, but the notch 112*g*, in which the insertion part 114*i* is to be received, is formed on the inner member 112. Therefore, a decrease in volume of a pressure chamber (e.g., a volume in the recess portion 101*a*) is prevented and thus volumetric efficiency can be further improved. Further, in terms of designing and manufacturing, the axial end portion (edge portion) of the member is cut out and the insertion part is formed to correspond thereto, and thus the formation position and shape allow designing and manufacturing to be relatively easily performed. In addition, adjustment of a driving torque for the gear pump 19 is just sufficient if a depth of the notch 112*g* (length of the insertion part 114*i*) is adjusted, thereby allowing manufacturing to be relatively easily performed. That is, manufacturability is further improved.

In particular, the gear pump device used for the brake actuator 50 is small in size, and also the outer member 114 and the inner member 112 which are components thereof are further smaller. Therefore, a simpler shape is preferable. That is, as compared with the case where minute protrusions are formed at specific locations as in a gear pump described in JP-A-2016-28192, it is easier to form a cutout or protrusion over the entire periphery of the edge portion and it is also relatively easy to adjust a driving torque (i.e., an area receiving a discharge pressure).

Further, the outer circumferential portion of the inner member 112 is formed in a stepped shape by the notch 112*g*, so that the annular rubber member 113 is arranged on an upper stage side (outer circumference side) and the insertion part 114*i* is arranged on a lower stage side (inner circumference side). Therefore, galling of the seal is prevented. In addition, in a cross section (radial cross section) as in FIG. 6, the inner member 112 is formed such that the outer circumferential wall thereof (excluding the tapered surface 112*e* and the notch 112*g*) and the inner circumference-side end face of the outer gear 19*a* are aligned on a straight line. By forming the notch 112*g* to have such a positional relationship, a structure can be effectively obtained, in which the minimum required pressure receiving area (the minimum required radial width of the protrusion part 114*c*) is provided.

Modifications

Figure 8:
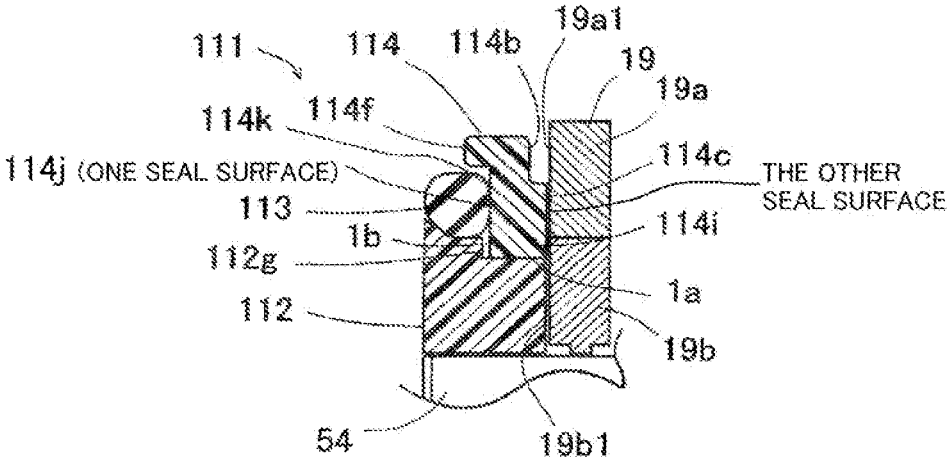
FIG. 8 is a schematic sectional view of a seal mechanism and a gear pump according to a modification of the present embodiment.

A modification of the present embodiment will be described with reference to FIG. 8. FIG. 8 is a conceptual diagram corresponding to FIG. 6. In the description of the modification, reference can be made to the foregoing description and drawings. As shown in FIG. 8, according to a configuration of the modification, a length of the insertion part 114*i* in the axial direction is equal to a length in the axial direction from the end face 114*j* of the outer member 114 to the distal end face of the protrusion part 114*c*. That is, the insertion part 114*i* is formed to have the same width as that of a portion constituted by the protrusion part 114*c* and the base part 114*k*. As a result, the outer member 114 can be formed in a shape similar to that of a conventional outer member 114. The insertion part 114*i* according to the modification is, for example, an inner circumference-side end portion of a protrusion portion of the conventional outer member 114.

The notch 112*g* of the inner member 112 is formed to correspond to a shape of the insertion part 114*i* and thus to allow the insertion part 114*i* to be arranged therein. Like the present embodiment, the notch 112*g* and the one axial end face 19*b*1 of the inner gear 19*b* define the depressed part 1*a*. The insertion part 114*i* is inserted in the depressed part 1*a* with a clearance 1*b* defined therebetween. Even due to this configuration, the same effects as those of the present embodiment are exhibited.

(Others)

The present invention is not limited to the foregoing embodiments. For example, the notch 112*g* and/or the insertion part 114*i* may have any other shapes and, for example, may be formed in a shape with a tapered surface, an unevenness shape, such as a gear meshing shape or a wave shape (i.e., a recess and/or a protrusion formed discontinuously in the pump circumferential direction), or an elliptical shape. However, for the shape of the notch 112*g* or/and the insertion part 114*i*, a continuously formed annular shape can be more easily manufactured and assembled, as compared with a discontinuous unevenness shape. In addition, for example, in the cross section as in FIG. 6, the inner member 112 may be formed such that the outer circumferential wall thereof (excluding the tapered surface 112*e* and the notch 112*g*) is positioned more toward the lower side (inner circumference side) or upper side (outer circumference side) than the inner circumference-side end face of the outer gear 19*a*. Further, the inner member 112 may be formed of a member (e.g., metal) having a Young's modulus higher than that of the outer member 114.

The invention claimed is:

1. A gear pump device, comprising:

a gear pump having an outer gear and an inner gear, wherein the outer gear has an internal tooth portion and the outer gear and the inner gear are configured to be meshed with each other while forming a plurality of void portions therebetween, wherein the gear pump is configured to suck and discharge a fluid as the outer gear and the inner gear are rotated by rotation of a shaft;

a case defining a receiving portion, in which the gear pump is received; and a seal mechanism arranged between the case and the gear pump and configured to partition a low pressure side, which includes a suction side of the gear pump sucking the fluid and the periphery of the shaft, and a high pressure side, which includes a discharge chamber of the gear pump allowing the fluid to be discharged therein;

wherein the seal mechanism comprises: an annular rubber member for sealing between the low pressure side and the high pressure side while surrounding the low pressure side; an outer member having two seal surfaces, one seal surface of the two seal surfaces abutting against the annular rubber member and the other seal surface of the two seal surfaces abutting against one axial end face of the outer gear and also against one axial end face of the inner gear; and an inner member having an outer circumferential wall allowing the annular rubber member to be mounted thereon and configured to be fitted in the outer member, wherein the inner member is configured to abut against an inner wall surface of the case opposite to the one axial end face of the inner gear, wherein the inner member has a notch on an axial end portion of the outer circumferential wall facing the inner gear, wherein the notch is configured to be recessed radially more inward of the inner gear than the annular rubber member and thus to define a depressed part together with the one axial end face of the inner gear, wherein the outer member has an insertion part configured to be arranged in the depressed part and also to abut against the one axial end face of the inner gear, wherein the insertion part constitutes a part of the other seal surface.

2. The gear pump device according to claim 1, wherein a length of the insertion part in the axial direction is equal to a length from the one seal surface to the other seal surface in the axial direction.

3. The gear pump device according to claim 1, wherein a length of the insertion part in the axial direction is smaller than a length from the one seal surface to the other seal surface in the axial direction.

4. The gear pump device according to claim 1, wherein the notch is an annular portion of the inner member, which is continuously formed over the entire periphery of the outer circumferential wall.

5. The gear pump device according to claim 2, wherein the notch is an annular portion of the inner member, which is continuously formed over the entire periphery of the outer circumferential wall.

6. The gear pump device according to claim 3, wherein the notch is an annular portion of the inner member, which is continuously formed over the entire periphery of the outer circumferential wall.

7. A gear pump device, comprising:

a gear pump having an outer gear and an inner gear, wherein the outer gear has an internal tooth portion and the outer gear and the inner gear are configured to be meshed with each other while forming a plurality of void portions therebetween, wherein the gear pump is configured to suck and discharge a fluid as the outer gear and the inner gear are rotated by rotation of a shaft;

a case defining a receiving portion, in which the gear pump is received; and a seal mechanism arranged between the case and the gear pump and configured to partition a low pressure side, which includes a suction side of the gear pump sucking the fluid and the periphery of the shaft, and a high pressure side, which includes a discharge chamber of the gear pump allowing the fluid to be discharged therein;

wherein the seal mechanism comprises: an annular rubber member for sealing between the low pressure side and the high pressure side while surrounding the low pressure side; an outer member having two seal surfaces, one seal surface of the two seal surfaces abutting against the annular rubber member and the other seal surface of the two seal surfaces abutting against one axial end face of the outer gear and also against one axial end face of the inner gear; and an inner member having an outer circumferential wall allowing the annular rubber member to be mounted thereon and configured to be fitted in the outer member, wherein the inner member is configured to abut against an inner wall surface of the case opposite to the one axial end face of the inner gear, wherein the inner member has a notch on an axial end portion of the outer circumferential wall facing the inner gear, wherein the notch is configured to be recessed radially inward of the inner gear and thus to define a depressed part together with the one axial end face of the inner gear, wherein the outer member has an insertion part configured to be arranged in the depressed part and also to abut against the one axial end face of the inner gear, wherein the insertion part constitutes a part of the other seal surface, wherein a length of the insertion part in the axial direction is smaller than a length from the one seal surface to the other seal surface in the axial direction.

8. The gear pump device according to claim 7, wherein the notch is an annular portion of the inner member, which is continuously formed over the entire periphery of the outer circumferential wall.

* * * * *